US008095994B2

(12) United States Patent
Natonson et al.

(10) Patent No.: US 8,095,994 B2
(45) Date of Patent: Jan. 17, 2012

(54) GARMENT-INTEGRATED PROPRIOCEPTIVE FEEDBACK SYSTEM

(75) Inventors: Hilary Natonson, Glencoe, IL (US); Ashley Ross, Chicago, IL (US)

(73) Assignee: Hilary Mass, Evanston, IL (US)

( * ) Notice: Subject to any disclaimer, the term of this patent is extended or adjusted under 35 U.S.C. 154(b) by 950 days.

(21) Appl. No.: 12/049,083

(22) Filed: Mar. 14, 2008

(65) Prior Publication Data

US 2008/0222771 A1 Sep. 18, 2008

Related U.S. Application Data

(63) Continuation-in-part of application No. 11/724,676, filed on Mar. 15, 2007, now abandoned.

(51) Int. Cl.
*A41D 1/04* (2006.01)
*A41D 27/02* (2006.01)
*A41D 13/018* (2006.01)

(52) U.S. Cl. ..... 2/102; 2/456; 2/69; 2/272; 2/DIG. 3

(58) Field of Classification Search ..... 601/148, 601/149, 150, 151, 152; 128/24 R, 33, 64, 128/70, 680, 683, 668; 2/102, 456, 458, 2/2.11, 2.14, 2.17, 69, 905, DIG. 3, 81
See application file for complete search history.

(56) References Cited

U.S. PATENT DOCUMENTS 4,120,297 A * 10/1978 Rabischong et al. ..... 602/19
4,353,359 A 10/1982 Milbauer
4,625,336 A * 12/1986 Derderian ..... 2/79
4,735,572 A * 4/1988 Clifford ..... 434/247
5,383,918 A * 1/1995 Panetta ..... 607/104
5,437,610 A * 8/1995 Cariapa et al. ..... 601/152
5,591,200 A * 1/1997 Cone et al. ..... 606/201
5,674,262 A * 10/1997 Tumey ..... 607/48
5,782,790 A 7/1998 Allen
5,830,164 A * 11/1998 Cone et al. ..... 601/152
5,843,007 A * 12/1998 McEwen et al. ..... 601/152
5,968,073 A * 10/1999 Jacobs ..... 606/202
6,179,796 B1 * 1/2001 Waldridge ..... 601/149
6,277,143 B1 * 8/2001 Klatz et al. ..... 607/104
6,315,745 B1 * 11/2001 Kloecker ..... 602/13
6,398,746 B2 * 6/2002 Bramlage et al. ..... 602/5

(Continued)

FOREIGN PATENT DOCUMENTS

WO WO-9930607 6/1999

(Continued)

OTHER PUBLICATIONS

Fertel-Daly, D., Bedell, G., & Hinojosa, J. "Effects of a Weighted Vest on Attention to Task and Self-Stimulatory Behaviors in Preschoolers With Pervasive Developmental Disorders," vol. 55, No. 6, AJOT, pp. 629-640 (2001).

(Continued)

*Primary Examiner* — Bobby Muromoto, Jr.
(74) *Attorney, Agent, or Firm* — Marshall, Gerstein & Borun LLP

(57) ABSTRACT

An apparatus, system, and method treat a neurological disorder by applying proprioceptive feedback to a wearer of a garment. Specifically, the garment includes one or more pressurizable reservoirs that, when pressurized, apply distributed pressure to the wearer. A system including the garment also includes a mechanism for pressurizing the reservoir and, optionally, a controller operable to control the pressurizing mechanism.

20 Claims, 8 Drawing Sheets

U.S. PATENT DOCUMENTS

| | | | | |
|---|---|---|---|---|
| 6,401,249 | B2 | 6/2002 | Haar et al. | |
| 6,436,064 | B1 * | 8/2002 | Kloecker | 602/13 |
| 6,540,707 | B1 * | 4/2003 | Stark et al. | 602/13 |
| 6,558,338 | B1 * | 5/2003 | Wasserman | 601/152 |
| 6,645,165 | B2 * | 11/2003 | Waldridge et al. | 601/152 |
| 6,654,967 | B2 | 12/2003 | Haar | |
| 6,757,916 | B2 * | 7/2004 | Mah et al. | 2/456 |
| 6,852,089 | B2 * | 2/2005 | Kloecker et al. | 602/75 |
| 6,872,187 | B1 * | 3/2005 | Stark et al. | 602/16 |
| 7,080,411 | B2 | 7/2006 | Kerr | |
| 7,314,478 | B2 * | 1/2008 | Hui | 606/202 |
| 7,354,410 | B2 * | 4/2008 | Perry et al. | 601/151 |
| 7,354,411 | B2 * | 4/2008 | Perry et al. | 602/13 |
| 7,416,537 | B1 * | 8/2008 | Stark et al. | 602/16 |
| 7,641,623 | B2 * | 1/2010 | Biondo et al. | 601/149 |
| 2002/0010409 | A1 * | 1/2002 | Bramlage et al. | 602/19 |
| 2002/0117101 | A1 * | 8/2002 | Duval et al. | 114/347 |
| 2002/0120288 | A1 * | 8/2002 | Dedo | 606/203 |
| 2002/0156340 | A1 * | 10/2002 | Blendermann | 600/15 |
| 2003/0144621 | A1 | 7/2003 | Osterbye et al. | |
| 2004/0054306 | A1 * | 3/2004 | Roth et al. | 601/152 |
| 2008/0222769 | A1 * | 9/2008 | Natonson et al. | 2/70 |
| 2008/0222771 | A1 * | 9/2008 | Natonson et al. | 2/102 |

FOREIGN PATENT DOCUMENTS

| | | |
|---|---|---|
| WO | WO-0053145 | 9/2000 |

OTHER PUBLICATIONS

Grandin, "Calming Effects of Deep Touch Pressure in Patients with Autistic Disorder, College Students, and Animals," Journal of Child and Adolescent Psychopharmacology, vol. 2, No. 1 (1992).

Grandin, "An Autistic Person's View of Holding Therapy," The Children's Center for Neurodevelopmental Studies, Research Section Communication vol. 12(3) (Dec. 1989).

VandenBerg, N. L.; "The Use of Weighted Vest to Increase On-Task Behavior in Children with Attention Difficulties," vol. 55, No. 6, AJOT, pp. 621-628.

Southpaw Enterprises Catalog, Date Unknown, pp. 96 and 102.

SkyMall Catalog, Date Unknown, pp. 133.

International Search Report for PCT/US2008/057101, mailed Jul. 17, 2008.

Written Opinion of the International Searching Authority for PCT/US2008/057101, mailed Jul. 7 2008.

Office Action mailed Dec. 12, 2008 for U.S. Appl. No. 11/724,676.

Flaghouse, formerly "Specials Populations" Spring 2010 Product Catalogue, www.flaghouse.com p. 26 (Spring 2010).

Tippy Swing, Product Catalogue, Members of the School Specialty Family, Special Needs Abilitations, www.schoolspecialty.com p. 235 (Summer 2010).

Abilitations "School Speciality" Fall 2010 Product Catalogue, Special Needs Abilitations, www.abilitations.com, p. 237 (Fall 2010).

Dewey-Hagborg, et al. "A collaboration of the Interactive Tellecommunications Program and the Department of Occupational Therapy", http://www.deweyhagborg.com/SmartHug/Smart Hug.htm, (2006).

* cited by examiner

GARMENT-INTEGRATED PROPRIOCEPTIVE FEEDBACK SYSTEM

CROSS-REFERENCE TO RELATED PATENTS AND PATENT APPLICATIONS

This application is a continuation-in-part of U.S. patent application Ser. No. 11/724,676, filed on Mar. 15, 2007, which is hereby incorporated by reference herein.

FIELD OF THE INVENTION

The present invention relates to a system used in the management of a neurological disorder, such as autism. More specifically, the system includes a garment containing one or more pressurizable reservoirs for applying proprioceptive feedback to a wearer of the garment.

BACKGROUND OF THE INVENTION

Autism is a neurological disorder characterized by difficulties with social interaction, speech, and communication, and by compulsive behavior. While there is no known cure for autism, some treatments have proven effective at treating some of the symptoms.

Proprioceptive feedback is one method that is sometimes used to help manage some of the symptoms of autism and other similar neurological disorders. Proprioceptive feedback involves providing stimuli to the nerves that detect and/or control movement and location of the muscles, tendons and joints. Sometimes proprioceptive feedback is accomplished by placing weights on the shoulder muscles of the affected individual. The effect of the weight, delivered by a weighted vest, for example, can help those with autism and other such disorders to control their level of arousal, focus their attention, and otherwise control compulsive and impulsive behaviors.

Unfortunately, at least some weighted vests tend to be rather bulky and unattractive. An affected person may have a harder time putting on or concealing a bulky vest, and may be less likely to continue wearing a bulky vest. Additionally, because the weight of a weighted vest is concentrated primarily on the person's shoulders, weighted vests tend to be relatively uncomfortable, which may also affect whether and how long the person wears the vest. The consequences of these potential disadvantages may ultimately affect the person's ability to hold a job, or to otherwise maintain his/her composure in public.

SUMMARY OF THE DISCLOSURE

A disclosed vest may provide relief from some symptoms of neurological disorders such as autism. Specifically, the system includes a pressurizable garment for applying proprioceptive feedback in the form of distributed pressure to a wearer's body. In particular, a vest having an incorporated pressurizable reservoir may be pressurized to apply comfortable pressure over a distributed area of the wearer's person. In one embodiment, the vest includes a shell, an adjustable first portion configured to wrap around the torso of a wearer, an adjustable pair of shoulder straps, and a fastening mechanism for securing the garment to the user. A pressurizable reservoir, having a plurality of channels formed therein, is disposed within the shell, and a valve provides flow communication into and out of the reservoir. The pressurizable reservoir extends into the pair of shoulder straps. A plurality of flexible inserts are disposed within the plurality of channels. In one embodiment, the flexible inserts are foam inserts, while in another embodiment, the flexible inserts are spiral bundling wrap. An impermeable material coats at least a portion of an interior surface of the shell, and the impermeable material forms at least a portion of the pressurizable reservoir. The vest includes a pressure sensor for sensing a pressure in the vest. In one embodiment, the sensor operates to indicate a pressure in the pressurizable reservoir, while in another embodiment, the sensors operates to indicate a pressure of the pressurizable reservoir against a wearer. In yet another embodiment, the vest may include a second pressurizable reservoir, which may or may not be in flow communication with the first reservoir. A second valve provides flow communication into and out of the second pressurizable reservoir where the second pressurizable reservoir is not in flow communication with the first pressurizable reservoir.

In another embodiment, a system includes a garment shell, a pressurizable reservoir disposed within the garment shell, and a plurality of channels formed within the pressurizable reservoir. A valve provides flow communication into and out of the pressurizable reservoir. A pressurizing mechanism, capable of pneumatically coupling to the pressurizable reservoir via the valve, operates to pressurize the pressurizable reservoir. A pressure sensor indicates a pressure associated with the system. A controller device communicatively coupled to the pressurizing mechanism and to the pressure sensor is responsive to the pressure sensor and operable to control the pressurizing mechanism.

In still another embodiment, a method for treating a patient having a neurological disorder includes placing an inflatable proprioceptive feedback garment on the patient and inflating a pressurizable reservoir disposed within the proprioceptive feedback garment to provide distributed pressure on areas of the patient in contact with the garment. In certain embodiments, this may include wrapping an adjustable first portion of the garment around the torso of the patient, securing the adjustable first portion of the garment around the torso of the patient with a fastener; and securing each of a pair of shoulder straps about the patient such that the shoulder straps extend over the shoulders of the patient. The method may also include coupling a pressurizing mechanism to a valve on the proprioceptive feedback garment, sensing a pressure, monitoring the sensed pressure in a controller communicatively coupled to the sensor, and ceasing to further increase the pressure within the pressurizable reservoir upon sensing that a pre-determined pressure has been achieved.

Figure 1:
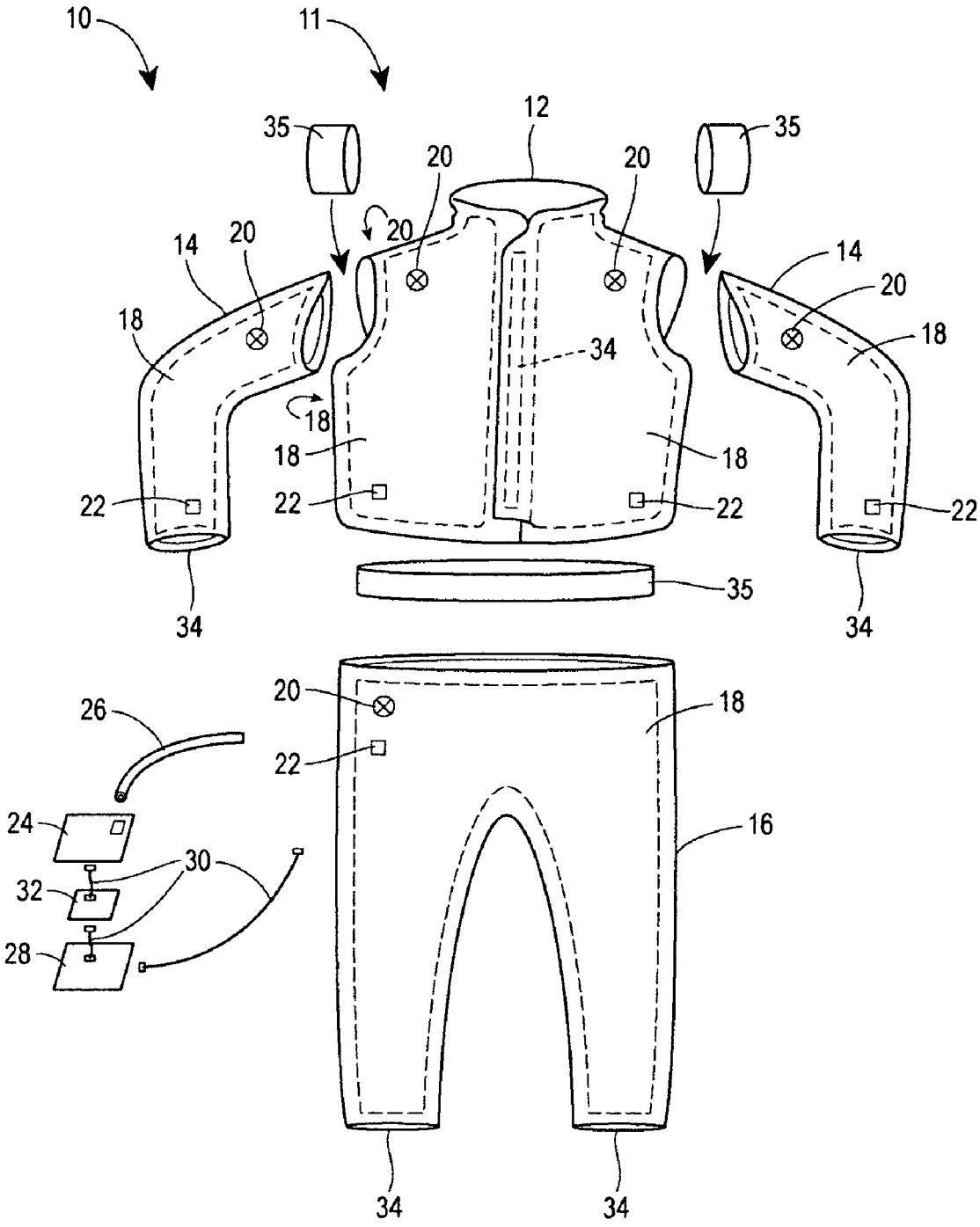
FIG. 1 illustrates one proprioceptive feedback system and garment in accordance with the present disclosure.

To facilitate understanding, identical reference numerals have been used, where possible, to designate identical elements that are common to the figures, except that suffixes may be added, when appropriate, to differentiate such elements. The images in the drawings are simplified for illustrative purposes and are not depicted to scale.

The appended drawings illustrate exemplary embodiments of the present disclosure and, as such, should not be considered as limiting the scope of the disclosure that may admit to other equally effective embodiments. It is contemplated that features or steps of one embodiment may beneficially be incorporated in other embodiments without further recitation.

DETAILED DESCRIPTION

The figures and description herein are directed to a system and a garment for treating a neurological disorder using proprioceptive feedback, and a method for treating a neurological disorder using the disclosed system or garment. While the neurological disorder contemplated in the present disclosure is autism, the concepts disclosed herein may also be applied in the context of other neurological disorders. The disclosed system and garment may also be employed in alternative contexts (i.e., other than the treatment of a neurological disorder), and the disclosure of the system and garment in the context of treating a neurological disorder does not limit the manner in which the system and garment may be employed.

FIG. 1 illustrates one embodiment of the disclosed proprioceptive feedback system 10. In the depicted embodiment, the system 10 includes a number of exemplary garments, including a vest 12, sleeves 14, and pants 16, all of which may be combined into a single garment 11. However, as described below, the system 10 may employ all, some, or only one of the vest 12, the sleeves 14, and the pants 16. For purposes of simplicity, the following discussion will refer primarily to the construction and use of one or more exemplary vests 12. However, those of skill in the art will realize that the sleeves 14 and/or the pants 16 may be added to the system 10 and/or may be constructed in the same manner as the vest or vests described below. Thus, hereinafter, the term "garment" refers interchangeably to the vest 12, the sleeves 14, the pants 16, or any combination thereof. In any event, the garment 11 is preferably constructed of a lightweight, flexible material such as nylon, polyester, spandex, etc., or some combination of those materials, so that movement is relatively unrestricted when the garment 11 is worn, and may be constructed so that it may be worn under other clothing, if desired. Other materials may prove suitable.

Referring still to FIG. 1, the garment 11 has one or more pressurizable reservoirs (e.g., inflatable bladders) 18. The reservoirs 18 may be filled with air (or other fluid) to create pressure against the body of a person wearing the garment 11. The reservoirs 18 may be separate components disposed within the garment 11, or may be integrally formed by the lightweight, flexible material of which the garment 11 is constructed. Of course, the garment 11 may, alternatively, have a single reservoir 18 extending throughout the garment 11. FIG. 1 depicts the vest 12 having two reservoirs 18 in the front and one reservoir 18 in the back, while depicting each of the sleeves 14 and the pants 16 as having a single reservoir 18 extending throughout. Additionally, multiple reservoirs 18 may be connected together within one of the vest 12, sleeves 14, and pants 16. Details of the construction of the garment 11, including the reservoir 18, are described below with respect to FIGS. 2-6.

A valve 20 is disposed in the garment 11, in fluid communication with each reservoir 18. Thus, FIG. 1 depicts the vest 12 as having three valves 20 (one of the valves is obscured in FIG. 1), with each valve 20 in fluid communication with a corresponding one of the three reservoirs 18 (two on the front of the vest 12, and one the back of the vest 12). Each of the sleeves 14 and the pants 16 is depicted with a single valve 20. A single valve 20 connected to one of the reservoirs 18 may be employed where multiple reservoirs 18 are connected together within the garment 11, as described above. The valves 20 may be any appropriate valves, depending on the type of fluid used and the materials from which the garment 11 and the reservoirs 18 are formed. However, the valve 20 should preferably allow air (or another fluid) to be introduced into and selectively discharged from the reservoir 18. The valve 20 should also maintain the pressure within the reservoir 18 (i.e., preferably the valve does not leak, or at least minimizes leakage) when no source of pressure is connected to it. A number of commercially available valves for use with inflatable reservoirs should prove suitable.

The garment 11 may also, in certain embodiments, include one or more sensors 22 for sensing a pressure in the reservoir or reservoirs 18. The sensors 22 may sense a pressure within the reservoir 18 or, alternatively, may sense a pressure outside the reservoir 18, such as the pressure exerted by the garment 11 against the wearer. The data from the sensors 22 may be used, for example, to prevent over-pressurization of the garment 11 such that the reservoirs 18 are not damaged or to prevent harm or discomfort to the wearer.

Various fasteners 34 may also be included on each of the vest 12, the sleeves 14, and the pants 16. The fasteners 34 act to secure the garment 11 on or around the person wearing it. The fasteners 34 may be any type of known fastener, such as hook-and-loop fastener (e.g., Velcro®), buttons, snaps, hooks, or buckles (e.g., feed-through buckles, cam buckles, squeeze-release buckles, etc.). Still other fasteners may prove suitable. Preferably, the fasteners 34 are adjustable, to allow one size of the garment 11 to fit a range of sizes of the wearer and/or to allow the garment 11 to remain snug on the wearer without becoming too tight as the reservoirs 18 are pressurized.

The garment 11 may also include joints 35, for example, connecting the sleeves 12 and the pants 16 to the vest 12. The joints 35 are preferably formed from the same lightweight, flexible material as the vest 12, the sleeves 14, and the pants 16, and include fasteners 38 for connecting the joints 35 to the vest 12, the sleeves 14, and the pants 16. Like the fasteners 34, the fasteners 38 may be any type of known fastener. Of course, when the garment 11 contemplates the inclusion of the joints 35, a complementary fastener 40 is provided on each of the vest 12, the sleeves 14, and the pants 16.

The system 10 also includes a pressurizing mechanism 24 for filling the reservoirs 18. The pressurizing mechanism 24 may be a mechanical pump (e.g., a squeeze bulb), an electrical pump, an air cartridge, or any other device capable of providing a pressurized fluid to the reservoir 18. A hose 26 connects the pressurizing mechanism 24 to any of the valves 20 on the garment 11, to couple the pressurizing mechanism 24 to the reservoir 18. Where the pressurizing mechanism 24 is used to pressurize multiple reservoirs 18 in the garment 11, the system 10 may employ multiple hoses 26 to couple the pressurizing mechanism 24 to each of the valves 20 to allow pressurization of each of the reservoirs 18 simultaneously. Of course, in this arrangement the pressurizing mechanism 24 would have multiple pressure outputs. Similarly, if the vest 12 (or the sleeves 14 or the pants 16) has more than one reservoir 18, multiple hoses 26 may be employed to couple the pressurizing mechanism 24 to each of the valves 20, to allow pressurization of each of the reservoirs 18 simultaneously. Alternatively, internal hoses (not shown) may couple the multiple reservoirs 18, so that pressure induced by the pressurizing mechanism 24 is communicated throughout the multiple reservoirs 18.

Where the system 10 employs an electrical pump as the pressurizing mechanism 24, the system 10 also includes a power source 32, which may be alternating current (AC) provided through an AC adaptor, direct current (DC) provided through a DC adaptor, a battery source, or any other known power source. Additionally, the pressurizing mechanism 24 may include a sensor 25 for sensing the pressure at the output of the pressurizing mechanism 24, as when an electrical pump is employed as the pressurizing mechanism 24. The system may also include a controller mechanism 28 when the pressurizing mechanism 24 is an electrical pump. The controller mechanism 28 uses data from the sensors 22 in the garment 11 and/or the sensor 25 in the pressurizing mechanism 24 to determine when to stop the pressurizing mechanism 24 from introducing further pressure into the reservoirs 18. In one embodiment wiring 30 connects the controller mechanism 28 to the pressurizing mechanism 24 and to the sensors 22 in the garment 11. Of course, the sensors 22 and 25 may alternatively be coupled to the controller mechanism 28 by various wireless technologies (e.g., Bluetooth).

Figure 2A:
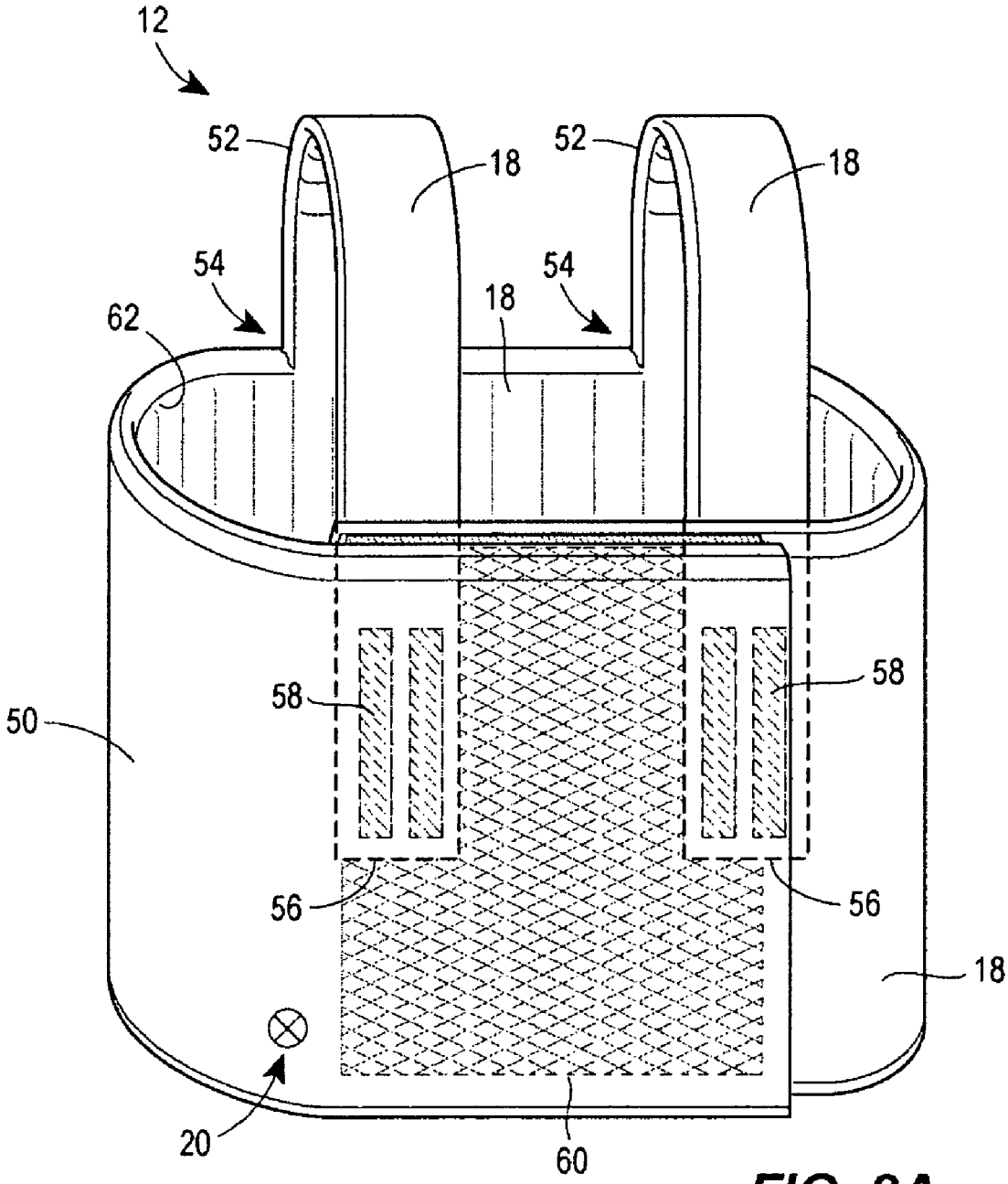
FIG. 2A is an enlarged perspective view of another exemplary garment in the form of a vest assembled in accordance with the teachings of the present disclosure.

FIG. 2A illustrates another exemplary embodiment for a vest 112. The vest 112 has a body 50 and two shoulder straps 52. The body 50 is appropriately sized to wrap around the trunk (e.g., from under the arms to around the waist) of the wearer, while the shoulder straps 52 connect the front of the vest 112 to the back of the vest 112, extending over the shoulders of the wearer. FIG. 2A depicts the shoulder straps 52 as integral with the body 50, extending from the body 50 at one end 54 of the shoulder straps 52, and attaching to the body 50 at a loose end 56 of the shoulder straps 52. The loose end 56 of the shoulder straps 52 is removably and adjustably fixed to the body 50 by a fastener 58, which, in the illustrated embodiment, is a hook-and-loop fastener (e.g., Velcro®), but may be any type of appropriate fastener. A similar fastener 60 adjustably and removably fixes the body 50 around the wearer.

Of course, the fasteners 58 and 60 have complementary fastener components (e.g., if 58 and 60 are the hook material, there must also be loop material). In the embodiment of FIG. 2A, an inner lining 62 of the vest 112 is loop material that forms the complementary fastener component for fasteners 58 and 60. Likewise, if fasteners 58 and 60 are the male component of a snap fastener, the inner lining 62 would, obviously, have an appropriate arrangement of complementary female components of the snap fasteners, such that the shoulder straps 52 and the body 50 may adjustably enclose the wearer. It should be clear that the shoulder straps 52 and the body 50 need not necessarily be adjustable, as when the garment 11 is sized specifically for the wearer. Those of skill in the art will recognize that there are many ways of designing the garment 11 that may negate the need for various fasteners (e.g., so that the vest 112 is pulled over the head of the wearer).

Figure 2B:
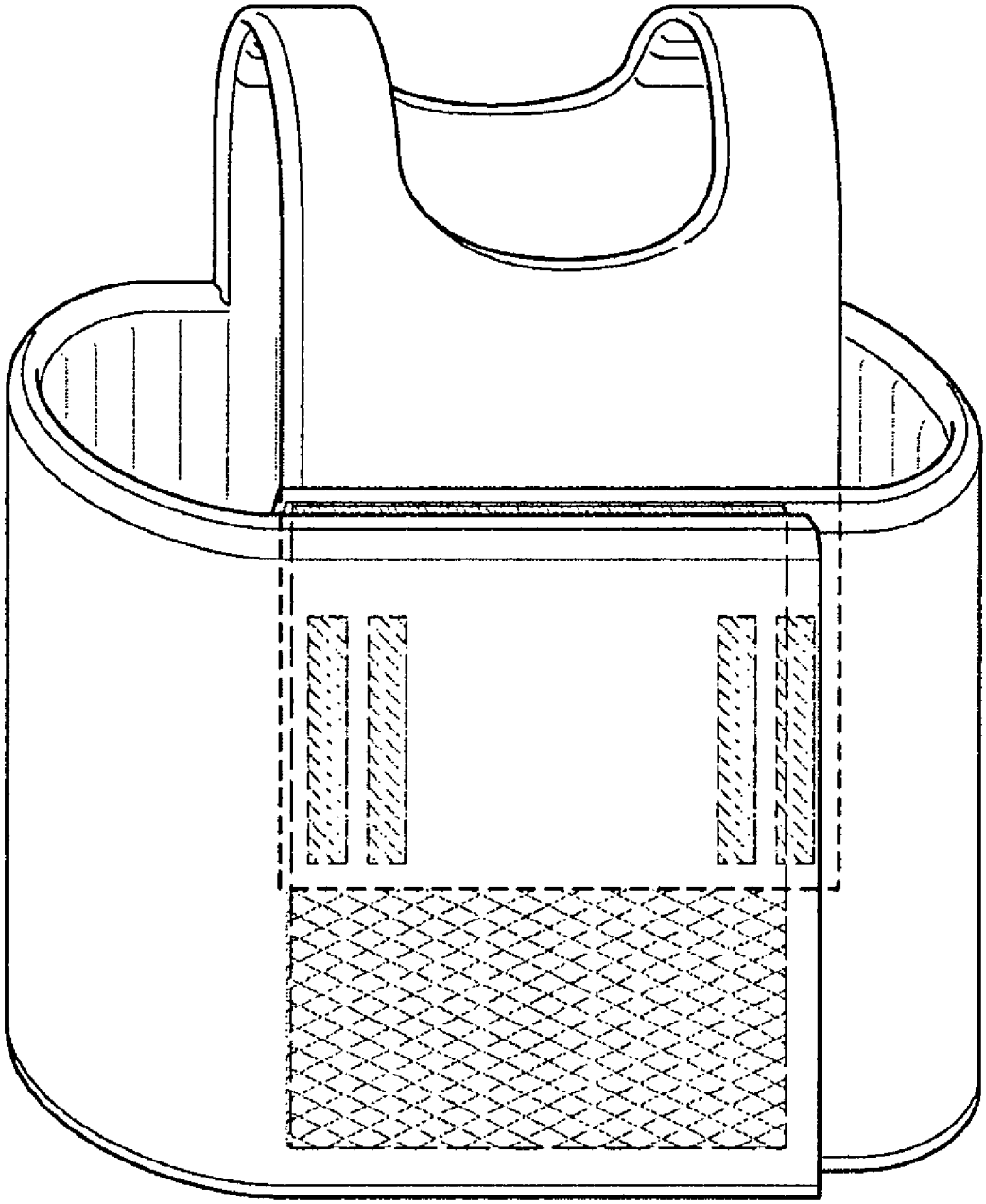
FIG. 2B is an enlarged perspective view of yet another exemplary garment assembled in accordance with the teachings of the present disclosure.

Additionally, a harness could be used instead of the shoulder straps 52. Accordingly, FIG. 2B illustrates another exemplary embodiment for a vest 212. The vest 212 has a body 250 and a harness 252. The body 250 is appropriately sized to wrap around the trunk (e.g., from under the arms to around the waist) of the wearer, while the harness 252 connects the front of the vest 212 to the back of the vest 212, extending over the shoulders of the wearer. A hole 255 disposed in the center of the harness 252 allows the harness 252 to fit over the head of a wearer. FIG. 2B depicts the harness 252 as integral with the body 250, extending from the body 250 at one end 254 of the harness 252, and attaching to the body 250 at a loose end 256 of the harness 252. The loose end 256 of the harness 252 is removably and adjustably fixed to the body 250 by a fastener 258, which, in the illustrated embodiment, is a hook-and-loop fastener (e.g., Velcro®), but may be any type of appropriate fastener. A similar fastener 260 adjustably and removably fixes the body 250 around the wearer.

Figure 3:
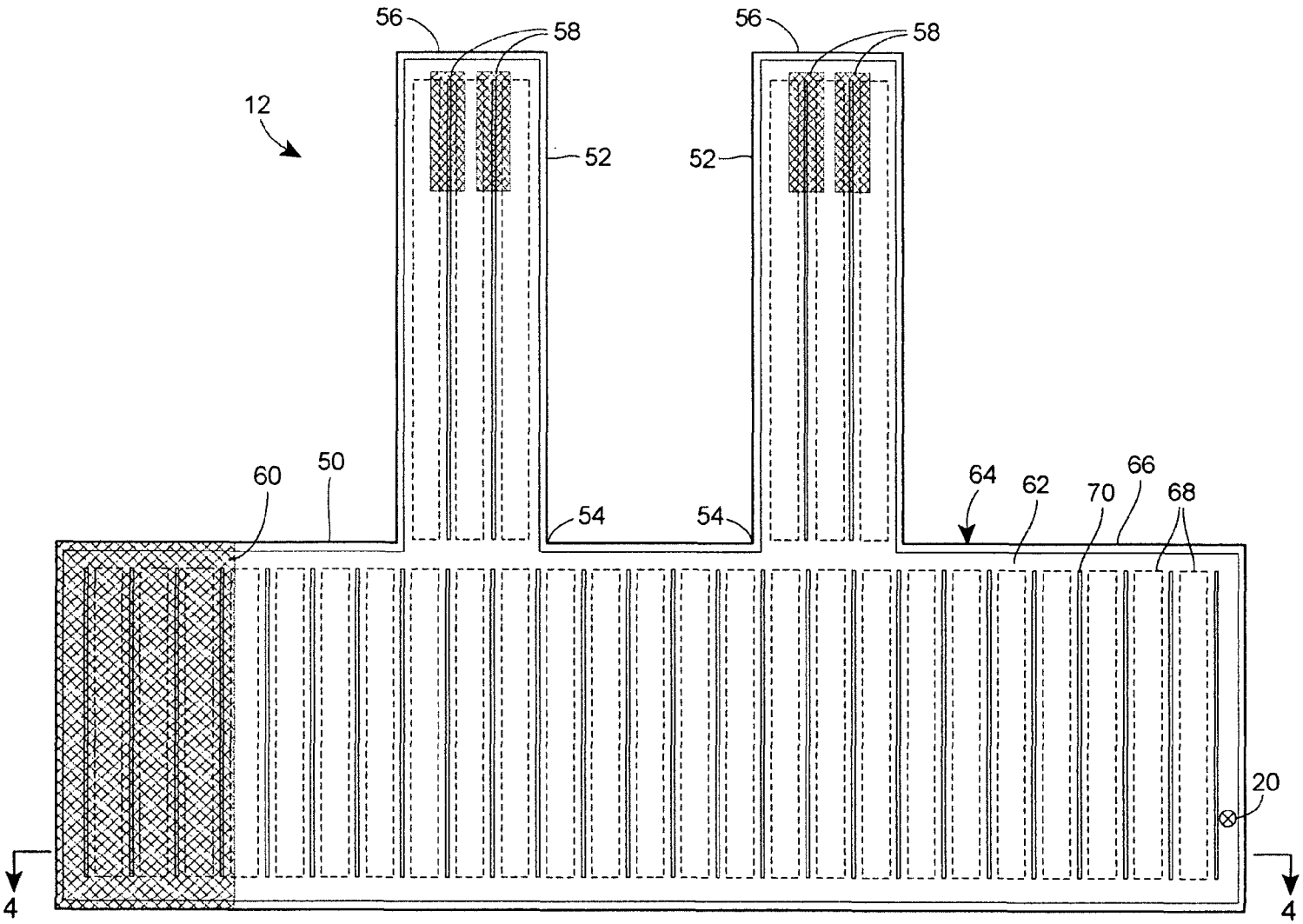
FIG. 3 is a plan view of still another exemplary garment assembled in accordance with the teachings of the present disclosure.

FIG. 3 illustrates additional details of the vest 112 depicted in FIG. 2A. In FIG. 3, the vest 112 is shown in plan view in a laid open state, such that the inner lining 62 is shown, and an outer lining 64 is hidden (the outer lining 64 is visible in FIG. 6). The vest 12 is depicted with the body 50 and the integral shoulder straps 52. Preferably, the vest 112 is fabricated from one or more pieces of material as will be explained in greater detail below. The reservoir or reservoirs 18 may be discrete reservoirs placed within the vest 112, or may be formed by the material from which the vest 112 is made. In the embodiment depicted in FIG. 3, the materials are sealed together using a high frequency weld 66, also known as a radio frequency weld, to form the reservoir 18. The high frequency weld 66 extends around the perimeter of the vest 12, joining the material together to form an airtight, enclosed space that forms the reservoir 18. Of course, other embodiments may employ different techniques to construct the jacket including, but not limited to, sewing the pieces together.

Preferably, the vest 112 includes a series of high frequency welds 70. The welds 70 are spaced apart and form or otherwise divide the reservoir 18 into a plurality of channels 67. In the example of FIG. 3, the channels 67 are all on flow communication with one another, all part of the same reservoir 18. In accordance with the disclosed example, the channels 67 operate to constrain or otherwise even out the pressure of the vest 112 against the wearer by preventing the outer lining 64 from expanding away from the inner lining 62.

The embodiment illustrated in FIG. 3 also includes a plurality of flexible inserts 68, disposed within the channels 67 of the vest 12. In accordance with the disclosed examples, the flexible inserts 68 serve to provide proprioceptive pressure to the wearer, and even may provide such pressure in certain circumstances in the absence of air pressure in the reservoir 18. The flexible inserts 68 are disposed in the reservoir 18, though in other embodiments, the flexible inserts 68 may be disposed between the inner lining 62 and the reservoir 18, between the outer lining 64 and the reservoir 18, elsewhere within the vest 12, or may be omitted entirely. The flexible inserts 68 preferably are made of foam, but may be formed from other suitable materials. For example, the inserts 68 may be made of other flexible materials, or flexible and compressible materials, that will provide a sense of pressure against the wearer even when the reservoir 18 is not pressurized. In one embodiment, the flexible inserts 68 are spiral bundling wrap, such as that sold by Ark-Plas Products®, Inc. In accordance with the disclosed example, the high frequency welds 70 separate the flexible inserts 68, and keeps them from moving within the vest 112.

Figure 4:
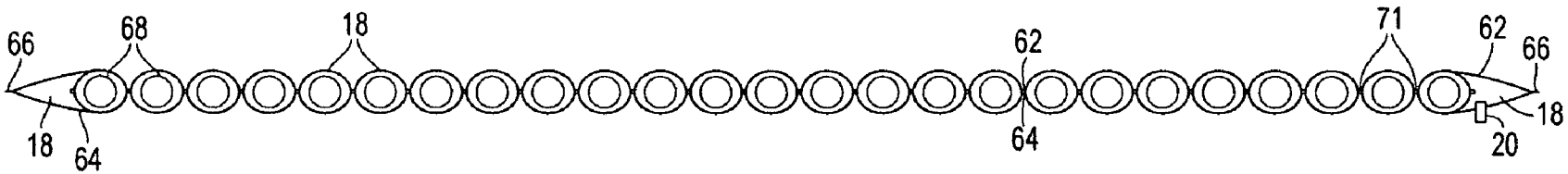
FIG. 4 is a cross-sectional view taken along line 4-4 of FIG. 3.
Figure 5:
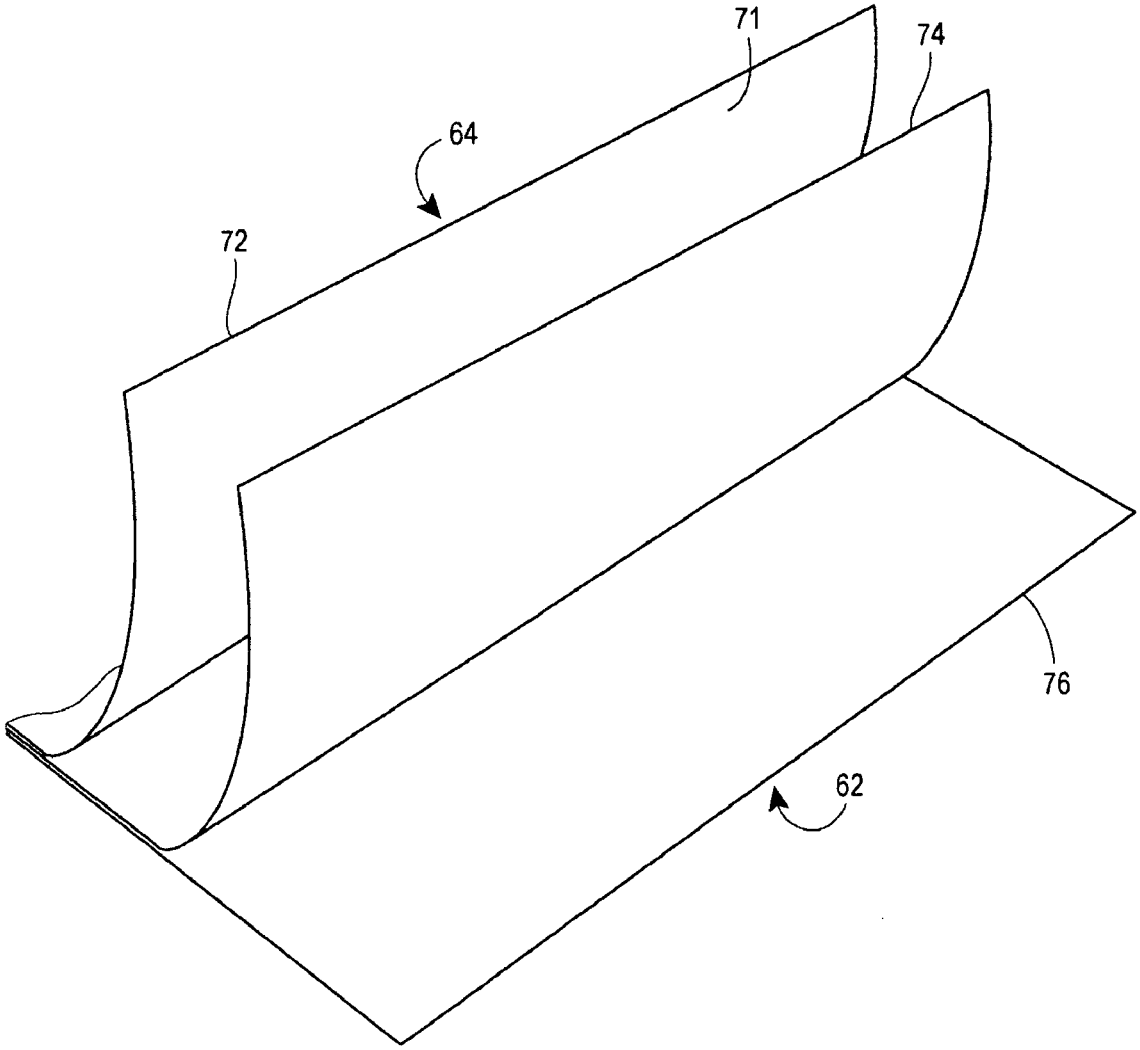
FIG. 5 is an enlarged view in perspective illustrating an exemplary three-layer construction for portions of the one or more of the foregoing exemplary garments.
Figure 6:
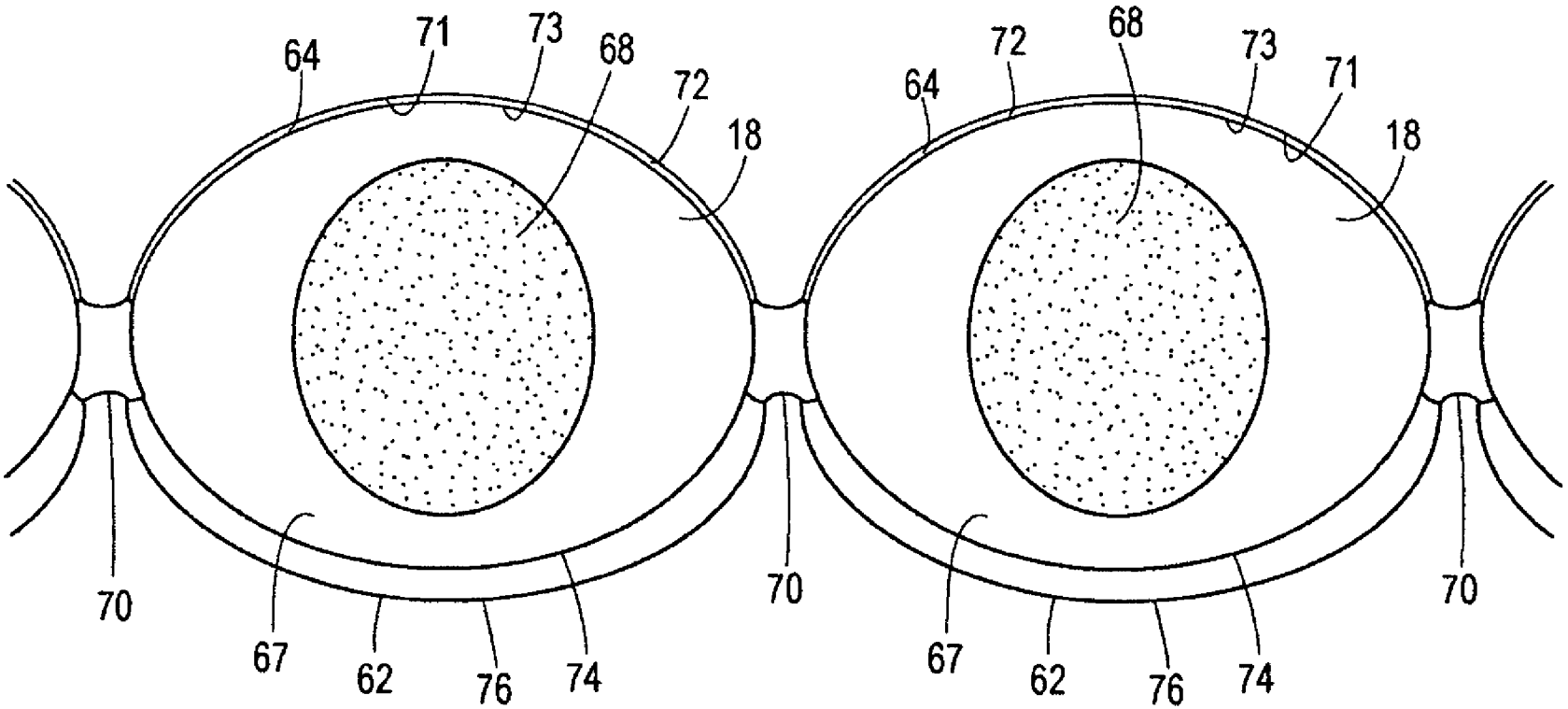
FIG. 6 is an enlarged fragmentary cross-sectional showing additional details of the exemplary three-layer construction.

FIG. 4 shows a cross-sectional illustration, taken along line 4-4 of FIG. 3, of the construction of the vest 12 depicted in FIG. 3. The high frequency weld 66 joins the inner lining 62 and outer lining 64 along the periphery of the vest 12. The high frequency welds 70 join the inner lining 62 and the outer lining 64, parallel to the flexible inserts 68. The inner lining 62 and the outer lining 64 cooperate to form the channels 67 in the reservoir 18, in which the flexible inserts 68 are disposed. The valve 20 is disposed in the outer lining 64, in fluid communication with the reservoir 18. Of course, the valve 20 need not be disposed in the outer lining 64, so long as it is in fluid communication with the reservoir 18. When the pressurizing mechanism 24 is connected to the valve 20, and used to pressurize the reservoir 18, the reservoir 18 fills with air (or, potentially, another fluid) and expands around the flexible inserts 68 to impart pressure against the body of the wearer.

The garment 11 is fabricated of two or more layers of material. In one embodiment, illustrated in FIGS. 5 and 6, an outer layer 72 includes the outer lining 64 and an inner surface 71. As described above, the outer lining 64 is a lightweight fabric, such as nylon. An elastomeric substance, such as polyurethane rubber forms a coating 73 that coats an inner surface 71 of the lightweight fabric to make the inner surface 71 airtight. Of course, the lightweight fabric need not be nylon, but could be any lightweight fabric suitable for a garment (e.g., polyester, spandex, rubber, etc.) and amenable to the fabrication process. Likewise, the elastomeric substance need not be polyurethane rubber, but may be any elastomeric substance having sufficient elasticity and air impermeability. In fact, any sufficiently impermeable material amenable to the chosen manufacturing technique may be employed.

A piece of elastomeric substance, such as the polyurethane coating the inner surface 71 of the outer layer 72 forms a middle layer 74 of the garment 11. The middle layer 74, when sealed to the outer layer 72 by a sealing method such as the high frequency welds 66 and 70, cooperates with the outer layer 72 to form the reservoir 18. When the pressurizing mechanism 24 introduces pressure to the reservoir 18, the two layers 72 and 74 contain the pressure, joined by the high frequency welds 66 and 70. Like the inner surface 71 of the outer layer 72, the middle layer 74 may be any elastomeric substance with appropriate properties, but is preferably the same substance as that which coats the inner surface 71 of the outer layer 72.

An inner layer 76 includes the inner lining 62 of the garment 11. The inner layer 76 may be any material suitable for the inner lining 62 of the garment 11. In the embodiment illustrated in FIGS. 2-4, the inner layer 76 includes the inner lining 62 made of "loop" material (i.e., the "loop" side of a hook-and-loop fastener), and a backing 78 that allows the inner layer 76 to be joined to the layers 72 and 74 using the chosen sealing method (e.g., high frequency welds 66 and 70).

Obviously, the garment 11 is not required to be formed in the manner described above. For example, the layers 74 and 76 could, when joined together, form the reservoir 18, or the layers 72 and 76 could form the reservoir 18 as depicted in FIG. 4. Additionally, as described above, the garment 11 could, as an alternative to forming the reservoir 18 using the layers 72 and 74, include a separate reservoir 18 disposed between two layers, such as by joining two middle layers, such as the middle layer 74. In such an embodiment, the separate reservoir 18 may be disposed, for example, between the inner layer 76 and the outer layer 72. When the reservoir 18 is separate from both of the inner layer 76 and the outer layer 72, the layers 76 and 72 may be joined by a method, such as machine-stitching, that does not provide a substantially airtight seal and, additionally, the elastomeric coating forming the inner surface 71 of the outer layer 72 may be omitted.

The reservoir 18 should substantially retain pressure introduced into the reservoir 18 by the pressurizing mechanism 24, regardless of whether the reservoir 18 is formed by the outer layer 72 and the middle layer 74, formed by the outer layer 72 and the inner layer 76, or formed separately from the outer layer 72 and the inner layer 76. While it is unnecessary for the reservoir 18 to maintain pressure indefinitely, it is preferable that the reservoir 18 maintain pressure for a period long enough that the therapeutic effects of the garment 11 are maintained without requiring the introduction of additional pressure on an ongoing basis. For example, an autistic patient may wear the garment 11 during working hours to allow the patient to function normally while at work, without requiring the patient to connect the pressurizing mechanism 24 to the garment 11 during a work shift. Thus, while this patent contemplates many methods of sealing the reservoir 18, preferred methods are those that maintain pressure for longer than four hours, and preferably for longer than eight hours, even when disconnected from the pressurization mechanism 24.

Figure 7:
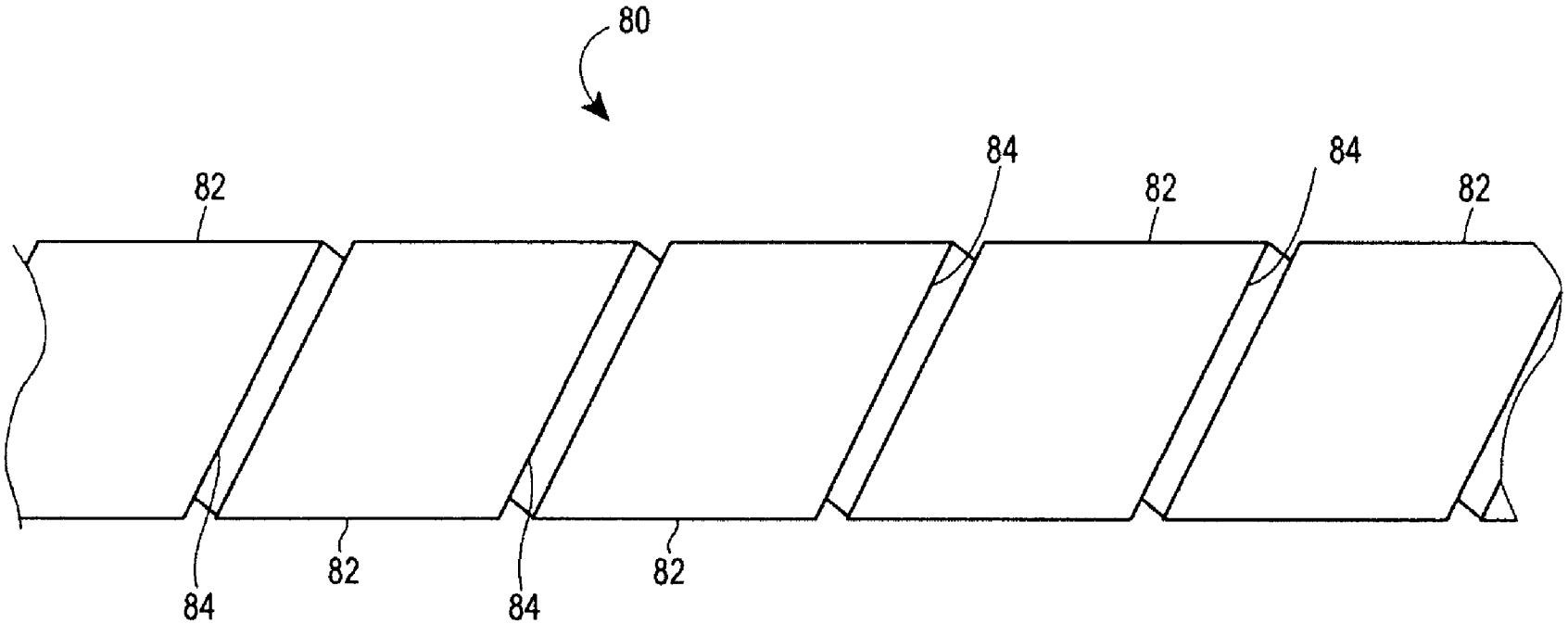
FIG. 7 is a fragmentary view illustrating an exemplary flexible insert in accordance with the teachings of the present disclosure.

As described above, the flexible inserts 68 may be formed from a material such as foam or, in an alternative embodiment, may be spiral bundling wrap. FIG. 7 depicts a segment of spiral bundling wrap 80. The spiral bundling wrap 80 is formed from a tube 82 of flexible material, such as polyethylene, in which a spiral cut 84 is made around the tube. The spiral bundling wrap 80, when placed in the channels 67 of the vest 112, forms the flexible inserts 68 for providing a sense of pressure against the wearer even when the reservoir 18 is not pressurized.

Although the preceding text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

We claim:

1. A vest comprising:

a shell having an interior surface and an exterior surface;

an adjustable first portion configured to wrap around the torso of a wearer;

a pair of adjustable shoulder straps;

a first pressurizable reservoir disposed within the shell;

a plurality of channels formed within the first pressurizable reservoir;

a first valve arranged to provide flow communication into and out of the first pressurizable reservoir; and a fastening mechanism wherein said vest provides proprioceptive feedback.

2. The proprioceptive feedback vest of claim 1, further comprising a plurality of flexible inserts, each of the flexible inserts disposed within a corresponding one of the plurality of channels.

3. The proprioceptive feedback vest of claim 2, wherein the plurality of flexible inserts are foam inserts.

4. The proprioceptive feedback vest of claim 2, wherein the plurality of flexible inserts are spiral bundling wrap.

5. The proprioceptive feedback vest of claim 1, wherein an impermeable material coats at least a portion of the interior surface of the shell, and further wherein the impermeable material forms at least a portion of the first pressurizable reservoir.

6. The proprioceptive feedback vest of claim 1, wherein the first pressurizable reservoir extends into the pair of shoulder straps.

7. The proprioceptive feedback vest of claim 1, further comprising a pressure sensor operable to indicate a pressure in the first pressurizable reservoir.

8. The proprioceptive feedback vest of claim 1, further comprising a pressure sensor operable to indicate a pressure of the first pressurizable reservoir against a wearer.

9. The proprioceptive feedback vest of claim 1, further comprising a second pressurizable reservoir, the second pressurizable reservoir in flow communication with the first pressurizable reservoir.

10. The proprioceptive feedback vest of claim 1, further comprising:

a second pressurizable reservoir not in flow communication with the first pressurizable reservoir; and a second valve arranged to provide flow communication into and out of the second pressurizable reservoir.

11. A method for treating a patient having a neurological disorder, the method comprising:

placing an inflatable proprioceptive feedback garment on the patient; and inflating a pressurizable reservoir disposed within the proprioceptive feedback garment to provide distributed pressure on areas of the patient in contact with the garment.

12. The method of claim 11, wherein placing an inflatable proprioceptive feedback garment on the patient comprises:

wrapping an adjustable first portion of the garment around the torso of the patient;

securing the adjustable first portion of the garment around the torso of the patient with a fastener; and securing each of a pair of shoulder straps about the patient, the shoulder straps extending over the shoulders of the patient.

13. The method of claim 11, wherein inflating a pressurizable reservoir comprises: coupling a pressurizing mechanism to a valve on the proprioceptive feedback garment;

sensing a pressure;

monitoring, in a controller communicatively coupled to the sensor, the sensed pressure; and ceasing to further increase the pressure within the pressurizable reservoir upon sensing that a pre-determined pressure has been achieved.

14. A garment-integrated proprioceptive feedback system comprising:

a garment shell;

a pressurizable reservoir disposed within the garment shell;

a plurality of channels formed within the pressurizable reservoir;

a valve arranged to provide flow communication into and out of the pressurizable reservoir;

a pressure sensor;

a pressurizing mechanism capable of pneumatically coupling to the pressurizable reservoir via the valve, and operable to pressurize the pressurizable reservoir; and a controller device communicatively coupled to the pressurizing mechanism and to the pressure sensor, the controller device responsive to the pressure sensor and operable to control the pressurizing mechanism thereby providing proprioceptive feedback.

15. A garment comprising:

a first garment shell;

a first pressurizable reservoir disposed within the first garment shell;

a plurality of channels formed within the first pressurizable reservoir; and a first valve arranged to provide flow communication into and out of the first pressurizable reservoir; wherein said garment provides proprioceptive feedback.

16. The proprioceptive feedback garment of claim 15, further comprising:

a second garment shell;

a second pressurizable reservoir disposed within the second garment shell; and a second valve arranged to provide flow communication into and out of the second pressurizable reservoir.

17. The proprioceptive feedback garment of claim 16, further comprising a plurality of flexible inserts disposed within the plurality of channels.

18. The proprioceptive feedback vest of claim 1, wherein the first pressurizable reservoir comprises one or more inflatable bladders and wherein each of the one or more inflatable bladders is filled with air to create pressure against the body of the wearer.

19. The proprioceptive feedback vest of claim 1, wherein the plurality of channels are in flow communication with one another.

20. The proprioceptive feedback vest of claim 2, wherein each of the plurality of flexible inserts is a flexible elongate body.

* * * * *